United States Patent [19]

Labbe

[11] Patent Number: 4,526,182

[45] Date of Patent: Jul. 2, 1985

[54] CIGARETTE MAKING MACHINES

[75] Inventor: Francis A. M. Labbe, Neuilly-sur-Seine, France

[73] Assignee: Molins plc, London, England

[21] Appl. No.: 369,026

[22] Filed: Apr. 16, 1982

[30] Foreign Application Priority Data

Apr. 16, 1981 [GB] United Kingdom ..... 8112184

[51] Int. Cl.[3] ..... A24C 5/39

[52] U.S. Cl. ..... 131/109.1; 131/110; 131/109.2

[58] Field of Search ..... 131/110, 109 R, 109 B, 131/109 AB, 84 R, 84 B; 209/639, 644

[56] References Cited

U.S. PATENT DOCUMENTS

| | | | |
|---|---|---|---|
| 3,189,034 | 6/1965 | Molins | 131/110 |
| 3,262,457 | 7/1966 | Gamberini | 131/110 |
| 3,443,688 | 5/1969 | Molins | 131/110 |
| 4,024,878 | 5/1977 | Labbe | 131/110 |

FOREIGN PATENT DOCUMENTS

| | | | |
|---|---|---|---|
| 934816 | 8/1963 | United Kingdom | 131/110 |

*Primary Examiner*—Vincent Millin

*Attorney, Agent, or Firm*—Antonelli, Terry & Wands

[57] ABSTRACT

A cigarette making machine includes a chimney (12, 14) and means (10) for projecting tobacco in a direction transverse to the chimney, from which direction lighter particles of tobacco tend to be deflected upwards into the chimney by an upwardly flowing air stream while heavier particles continue past the lower end of the chimney directly towards a projector roller (26) which is arranged to project the heavier particles downwards at a controlled velocity and in a controlled direction (inclined to the vertical) into a duct (30) through which at least part of the air entering the chimney flows upwards. Lighter particles of tobacco which are entrained with the heavier particles tend to be carried upwards, into the chimney, by the air flowing up the duct, while the heavier particles drop to the bottom of the duct and are removed.

17 Claims, 4 Drawing Figures

CIGARETTE MAKING MACHINES

In a well known form of cigarette making machine a cigarette filler stream is formed on the underneath surface of a suction band, tobacco being fed towards the suction band up a chimney with the aid of an upwardly flowing air stream. The filler stream carrier by the band is trimmed by a trimmer and is then deposited on a continuous wrapper web in which the tobacco is enclosed to form a cigarette rod. Examples of machines of that type are the Molins' Mark 8 and Mark 9 cigarette making machines. Certain features of such machines are also described in British patent specifications Nos. 934816, 937228 and 971636.

It is usual to winnow the tobacco before it is fed to the suction band. Some winnowing systems are described in the above mentioned patent specifications. The present invention is concerned with an improved winnowing arrangement.

According to the present invention, a cigarette making machine including an upwardly extending chimney and means for delivering tobacco into the lower end of the chimney is characterised in that the tobacco delivery means is arranged to project the tobacco in a direction transverse to the chimney, from which direction lighter particles of tobacco are deflected upwards into the chimney by an upwardly flowing air stream (in a manner known per se) while heavier particles of tobacco continue past the lower end of the chimney towards a roller which is arranged to project the heavier particles of tobacco downwards at a controlled velocity into a duct through which at least part of the air entering the chimney flows upwards, the projector roller being arranged to project the heavier particles of tobacco along a path which is inclined inwardly towards the centre of the duct. This arrangement helps to ensure that the heavier particles of tobacco do not slide down one wall of the duct, but instead tend to pass into a central region of the duct in which any lighter particles to tobacco carried by the heavier particles can be entrained in the air flowing up the duct and can thus be delivered into the chimney.

Preferably the projector roller is arranged to project the heavier particles of tobacco along a wall inclined to the vertical, the angle of inclination being preferably adjustable. The air flow up the duct is also preferably adjustable. Thus, what may be termed the "secondary winnowing" of the tobacco is adjustable in regard to the extent to which lighter particles of tobacco are redirected upwards to join the main flow of tobacco entering the chimney.

In a preferred arrangement according to this invention, heavier particles of tobacco (e.g. pieces of stem) which arrive at the lower end of the duct are preferably conveyed away by means of a rotating valve member which discharges the heavy particles of tobacco without allowing through it any significant flow of air, air being delivered into the lower end of the duct via a separate inlet.

Examples of machines according to this invention are shown in the accompanying drawings. In these drawings:

FIG. 1 is a sectional view of one machine;

Figure 2:
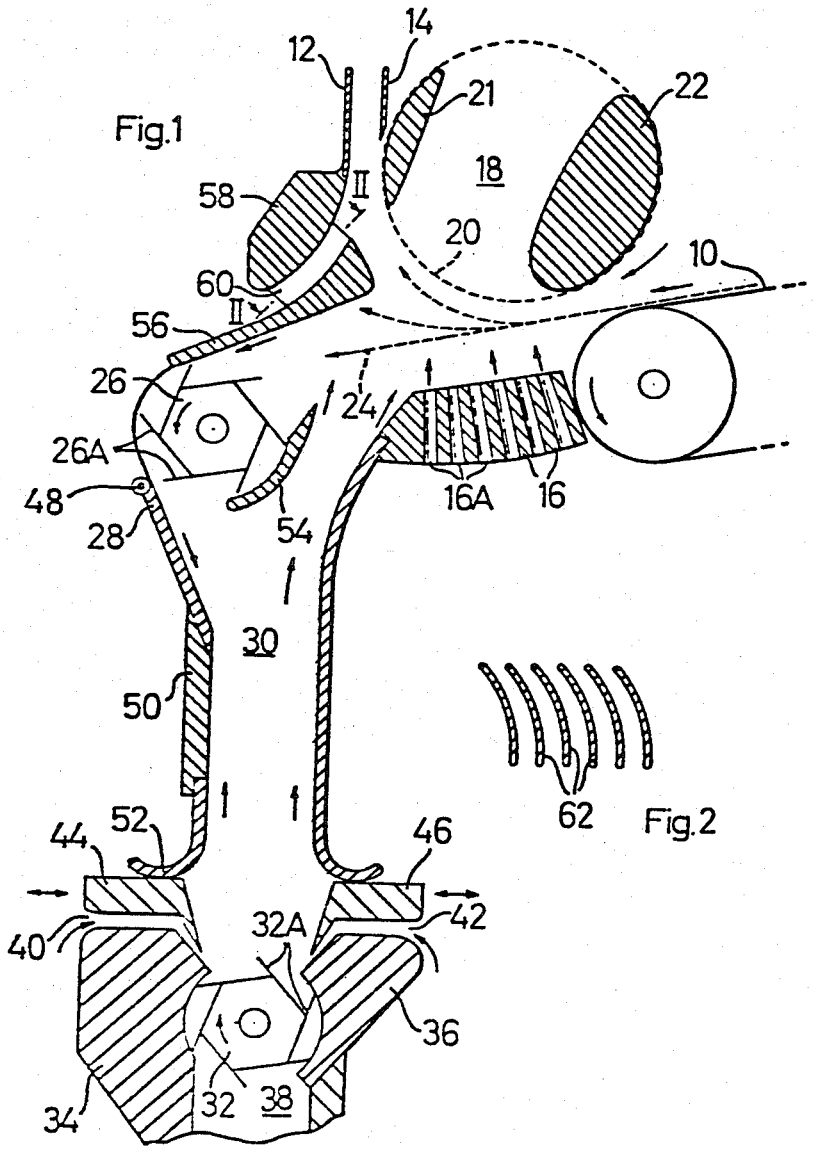
FIG. 2 is a section along the line II—II in FIG. 1.

FIG. 1 shows a machine in which a carpet of tobacco is conveyed substantially horizontally by a conveyor band 10 for delivery into the lower end of a vertically extending chimney formed by walls 12 and 14. Lighter particles of tobacco are deflected into the chimney, mainly by jets of air directed upwards from ports 16A in a jet block 16. Air is sucked upwards through the ports 16A owing to suction pressure above the jet block induced partly by suction transmitted to a chamber 18 within a porous roller 20, the pressure below the jet block being substantially atmospheric. The suction chamber 18 is defined partly by fixed members 21 and 22 around which the suction roller 20 rotates. The arrangement of the suction roller 20 and jet block 16 is basically as described in British patent specification No. 988448.

Relatively heavy particles of tobacco are not deflected into the chimney but pass instead approximately along the trajectory 24 and arrive on top of a projector roller 26 having six circumferentially spaced vanes 26A. The roller 26 rotates at a speed (e.g. 200 rpm) sufficient at least to maintain the momentum of the tobacco particles and to project those particles downwards along a wall 28 which is inclined to the vertical (as shown in the drawing) by approximately 23°. Thus the relatively heavy particles of tobacco are projected towards the center of a duct 30, up which air passes as a result of the suction pressure at the lower end of the chimney 12, 14. Lighter particles of tobacco carried downwards with the heavier particles tend to be entrained in the air flowing through the duct 30 and therefore pass into the chimney 12, 14. Particles of tobacco which are not light enough to be entrained in the air flow in the duct 30 drop through the duct and fall onto a rotary valve member 32 rotating between fixed members 34 and 36. This valve member 32 conveys the heavy particles of tobacco into a channel 28 from which they may be removed in any convenient way. Vanes 32A on the valve member 32 substantially prevent any air flow through the valve.

Air enters the lower end of the duct 30 through slots 40 and 42 formed between the fixed members 34 and 36 and horizontally adjustable members 44 and 46 respectively. It will be understood that adjustment of the members 44 and 46 towards one another will increase the air flow into the duct, and vice versa.

The inclined wall 28 is adjustable as to its inclination about a pivot 48, and carries with it a front wall 50 of the duct 30 and a curved member 52 forming a contact seal with the horizontally adjustable member 44.

A fixed wall 54 forms a partial shroud around the projector roller 26 to guide the air from the duct 30 (together with particles of tobacco entrained in the air) around the roller 26 and towards the lower end of the chimney 12, 14.

It should be noted that a fixed wall 56 above the projector roller 26 is inclined to the horizontal, so that relatively heavy particles of tobacco passing along trajectories slightly higher than the trajectory 24 will hit the wall 56 and be deflected onto the roller 26.

Between the wall 56 and a fixed member 58 there is an air inlet 60 containing evenly spaced vanes 62 which deflect the air streams passing between the vanes so as to produce a horizontal component of motion. This feature may be used if the chimney 12, 14, as viewed from the left of FIG. 1, is arranged to slope to the left in order to carry the tobacco particles upwards with a component of motion in the direction of movement of the suction band (not shown) moving along the top of the chimney. The shapes of the vanes 62 are shown in FIG. 2. Air flow inwards between the vanes is induced by the suction pressure in the chimney; alternatively, or in addition, air may be blown inwards from a source of air at above atmospheric pressure.

In FIG. 1, suction in the area above the jet block 16 and above the adjacent end of the conveyor band 10 may be sealed in by means of a roller cooperating with the conveyor band 10 as described in British Patent Specification No. 1504732.

Figure 3:
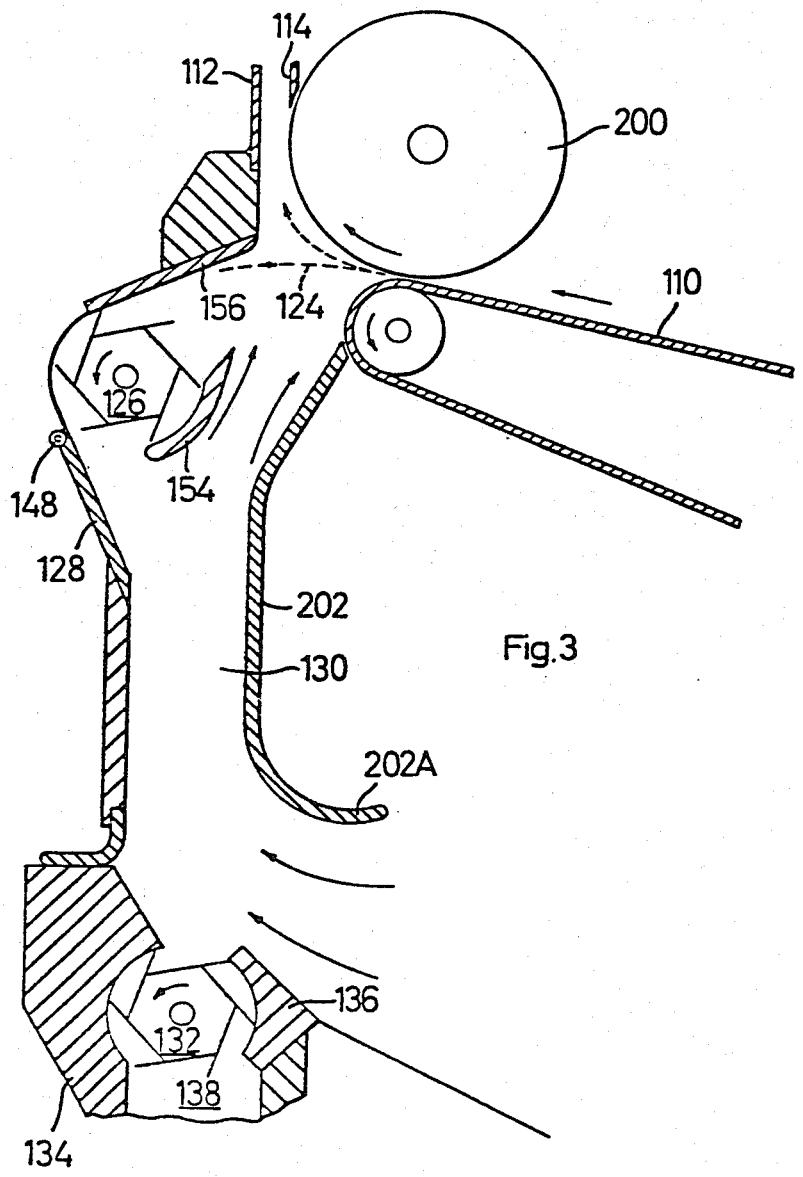
FIG. 3 is a view, similar to FIG. 1, of a different machine.

FIG. 3 shows a different machine. Parts which correspond to parts shown in FIG. 1 have been given a similar reference numeral to which 100 has simply been added.

In place of the suction roller 20 in FIG. 1, there is a solid roller 200, and there is no jet block. Thus all the air passing up the chimney 112, 114 is derived from the duct 130. Air enters the duct at the lower end via an inlet defined between the fixed member 136 and a curved lower portion 202A of a wall 202. There is no provision for letting in air, or blowing in air, directly into the lower end of the chimney via a vaned inlet as in FIG. 1.

Figure 4:
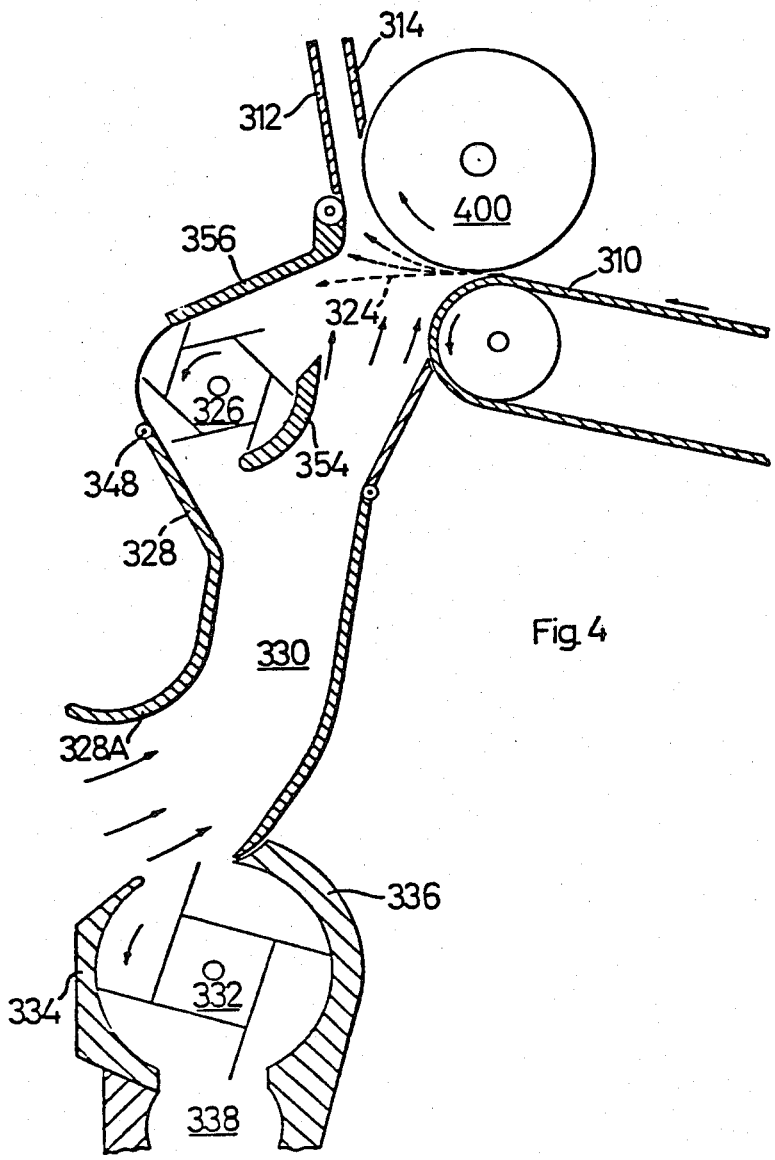
FIG. 4 is another view, similar to FIG. 1, of yet another different machine.

FIG. 4 shows another different machine according to this invention. Again, parts corresponding to parts in FIG. 1 have the same reference numerals, but in this case with the addition of 300.

As in the example shown in FIG. 3, there is a solid roller 400 above the downstream end of the conveyor band 310, and no jet block. Again, all the air passing into the chimney 312, 314 also passes upwards through the duct 330. In this example, the air inlet to the duct is defined by the fixed member 334 and a curved lower end portion 328A of the wall 328.

The arrangement shown in FIG. 4 is particularly suitable for use in combination with the form of chimney described in U.S. Pat. No. 4,041,959.

I claim:

1. A cigarette making machine including an upwardly extending chimney, means for delivering tobacco into the lower end of the chimney, a downwardly extending duct below the chimney through which at least part of the air entering the chimney flows upwardly, and a projector roller disposed downstream of said duct along the direction of delivery of said tobacco, the tobacco delivery means being arranged to project the tobacco in a direction transverse to the chimney, from which direction lighter particles of tobacco are deflected upwards into the chimney by an upwardly flowing air stream while heavier particles of tobacco continue past the lower end of the chimney, across the top of the duct and towards said projector roller which is arranged to project the heavier particles of tobacco downwards at a controlled velocity directly into said downwardly extending duct, the projector roller having outwardly extending tobacco engaging elements around its circumference and being arranged to project the heavier particles of tobacco along a path which is inclined inwardly towards the center of the duct.

2. A cigarette making machine according to claim 1 in which the outwardly extending tobacco engaging elements are vanes.

3. A cigarette making machine according to claim 1 or claim 2 in which the duct is substantially vertical, and the projector roller is arranged to project the heavier particles of tobacco along a wall which is inclined to the vertical.

4. A cigarette making machine according to claim 3 in which the inclined wall is mounted so as to be adjustable with respect to its angle of inclination to the vertical.

5. A cigarette making machine according to claim 1 in which the path along which the heavier particles of tobacco are projected by the projector roller extends around one side of the projector roller, and including a wall adjacent to the projector roller and extending around the other side of the projector roller for guiding around the projector roller the air flowing up the duct.

6. A cigarette making machine according to claim 1, including means for adjusting the air flow in the duct.

7. A cigarette making machine according to claim 1, 2 or 3, including a deflector wall which is mounted above the projector roller and is arranged to deflect downwards onto the projector roller some of the relatively heavy particles of tobacco.

8. A cigarette making machine according to claim 7 including a slot above the deflector wall for admitting air into the lower end of the chimney from atmosphere or from an above-atmospheric source and including vanes arranged to deflect the air passing through the slot to provide a horizontal component of motion in a direction transverse to the direction in which the tobacco is projected by the tobacco delivery means.

9. A cigarette making machine including an upwardly extending chimney and means for delivering tobacco into the lower end of the chimney, the tobacco delivery means being arranged to project the tobacco in a direction transverse to the chimney, from which direction lighter particles of tobacco are deflected upwards into the chimney by an upwardly flowing air stream while heavier particles of tobacco continue past the lower end of the chimney towards a roller which is arranged to project the heavier particles of tobacco downwards at a controlled velocity into a substantially vertical duct through which at least part of the air entering the chimney flows upwards, the projector roller being arranged to project the heavier particles of tobacco along a path inclined inwardly towards the center of the duct and defined by a wall inclined to the vertical, the wall being adjustable so as to vary its angle of inclination to the vertical.

10. A cigarette making machine including an upwardly extending chimney and means for delivering tobacco into the lower end of the chimney, the tobacco delivery means being arranged to project the tobacco in a direction transverse to the chimney, from which direction lighter particles of tobacco are deflected upwards into the chimney by an upwardly flowing air stream while heavier particles of tobacco continue past the lower end of the chimney towards a roller which is arranged to project the heavier particles of tobacco downwards at a controlled velocity into a duct through which at least part of the air entering the chimney flows upwards, the projector roller being arranged to project the heavier particles of tobacco along a path inclined to the general direction of the air flow through the duct and inclined inwardly towards the center of the duct, and defined by a wall, which is adjustable so as to vary its angle of inclination of the direction of the air flow through the duct.

11. A cigarette making machine according to claim 10 in which the projector roller has vanes for engaging and propelling the heavier particles of tobacco.

12. A cigarette making machine according to claim 11 in which the vanes drive the heavier particles of tobacco along a concave wall which is arranged about the center of the projector roller and from which the projector roller projects the heavier tobacco particles along the inclined path.

13. A cigarette making machine including an upwardly extending chimney and means for delivering tobacco into the lower end of the chimney, the tobacco delivery means being arranged to project the tobacco in a first direction transverse to the chimney, from which direction lighter particles of tobacco are deflected upwards into the chimney by an upwardly flowing air stream while heavier particles of tobacco continue past the lower end of the chimney towards a roller which is arranged to project the heavier particles of tobacco downwards at a controlled velocity into a duct through which at least part of the air entering the chimney flows upwards, the projector roller being arranged to continue the motion of the heavier particles of tobacco in substantially the said first direction and at least to maintain the momentum of the tobacco particles.

14. A cigarette making machine including an upwardly extending chimney and means for delivering tobacco into the lower end of the chimney, the tobacco delivery means being arranged to project the tobacco in a direction transverse to the chimney, from which direction lighter particles of tobacco are deflected upwards into the chimney by an upwardly flowing air stream while heavier particles of tobacco continue past the lower end of the chimney towards a roller which is arranged to project the heavier particles of tobacco downwards at a controlled velocity into a duct through which at least part of the air entering the chimney flows upwards, the projector roller being arranged to drive the heavier particles of tobacco along a concave wall from which they are projected into the duct.

15. A cigarette making machine as claimed in claim 14 including an additional wall extending from the concave wall and defining a path for the tobacco particles which is inclined inwardly towards the center of the duct.

16. A cigarette making machine as claimed in claim 15 in which the additional wall is adjustable to vary its angle of inclination to the duct.

17. A cigarette making machine as claimed in claim 14 in which the duct is defined by downwardly extending spaced walls, the trajectory of the particles projected by the roller extending obliquely through a portion of the duct defined by the spaced walls.

* * * * *